US006964590B1

(12) United States Patent
Ha

(10) Patent No.: US 6,964,590 B1
(45) Date of Patent: Nov. 15, 2005

(54) LATERAL THRUST DRIVE UNIT FOR MARINE VESSELS

(76) Inventor: Don Dongcho Ha, 404 E. First St., #607, Long Beach, CA (US) 90802

( * ) Notice: Subject to any disclaimer, the term of this patent is extended or adjusted under 35 U.S.C. 154(b) by 0 days.

(21) Appl. No.: 10/983,435

(22) Filed: Nov. 6, 2004

(51) Int. Cl.[7] ..... B63H 1/16
(52) U.S. Cl. ..... 440/67; 114/151
(58) Field of Search ..... 114/151; 440/6, 440/53, 61 R, 63, 67

(56) References Cited

U.S. PATENT DOCUMENTS

| | | | | | |
|---|---|---|---|---|---|
| 2,809,605 | A | * | 10/1957 | Russell | 440/61 R |
| 3,185,122 | A | * | 5/1965 | Pleuger | 114/151 |
| 4,732,104 | A | * | 3/1988 | Roestenberg | 114/151 |
| 5,152,240 | A | * | 10/1992 | Fontanille | 114/151 |
| 5,435,763 | A | * | 7/1995 | Pignata | 440/67 |
| 5,704,306 | A | * | 1/1998 | Den Ouden | 114/151 |

* cited by examiner

*Primary Examiner*—Lars A. Olson

(57) ABSTRACT

A thrust drive unit for generating side thrust for improved maneuverability of a marine vessel employs a peripherally-driven propeller situated below the waterline and remotely powered by a motor situated well above the waterline via a drive belt. The propeller is supported by the two ends of the coaxial shaft by a pair of supports which are mounted on either side of the casing and are angularly adjustable with respect thereto about the thrust axis to a position which is least resistance-generating for a particular installation of the thrust drive unit on a vessel. The lower portion disposed for submerged operation has a substantially blade-like cross section with a narrow thickness aligned transversely to the longitudinal axis of the vessel. The cross section of the submerged portion is streamline shaped to help further minimize the resistance. Such hydro-dynamically efficient design makes the present invention well suited for being fixedly mounted in the operating position on a vessel for mechanical simplicity and ease of use, without compromising the vessel's performance.

20 Claims, 7 Drawing Sheets

LATERAL THRUST DRIVE UNIT FOR MARINE VESSELS

BACKGROUND OF THE INVENTION

1. Technical Field

This invention relates to a lateral thrust drive unit externally mounted at the bow or the stern of a vessel for improving the slow speed maneuvering thereof, more particularly to such thrust drive unit which is adapted for fixed mounting in the operating position for simplicity and ease of operation.

2. Description of the Related Art

The maneuvering of a vessel in close quarters as during docking and undocking is often challenging using only the vessel's main propulsion and steering systems. It is especially difficult for those vessels equipped with an inboard engine with a single screw propulsion system and steered by an ordinary rudder. In most cases, the rudders are configured for optimum performance within the structurally acceptable limits for the maximum operating speed intended for the vessel, and as a result, are often insufficient for adequate steering control at slow speeds. The problem is compounded by the presence of a paddle-wheel phenomenon pronouncedly noticeable with such inboard single screw vessels, wherein the prop-wash created by the rotating propeller generates a swirling movement in the water below the hull to cause the stern of the vessel to drift sideways. In the case of a clockwise rotating propeller, as viewed toward the bow, this phenomenon causes the stern of the vessel to tend to drift toward the starboard side while traversing forward and toward the port side while in reverse. The effect is opposite with a counter-clockwise rotating propeller. The steering control at slow speeds may prove further challenging if there are any prevailing wind or current conditions which may cause the bow and/or stern of the vessel to veer off from the intended course in an unpredictable manner. As a result of all of these, a vessel with an inboard engine and with single screw propulsion system therefore is known to have a very little steering control while traversing forward at a slow speed and a little or no steering control at all while traversing in reverse.

A vessel with other types of propulsion and steering systems, such as those with an outboard engine or an outdrive system as commonly used in many small modern pleasure and fishing crafts have the ability to adjust the thrust vector via steering control input. That is, by pivoting the rotating axis of the propeller about the vertical axis, a lateral component in the propeller thrustline may be created which will enable the vessel to be steered even at a slow speed and while moving forward or rearward. Also, a vessel with a counter-rotating twin-screw propulsion system as commonly found in many larger pleasure and commercial vessels have the ability to independently control the thrust direction of each of the two propellers. By operating one propeller in the forward direction and the other in reverse, the vessel may be rotated about a vertical axis even without any substantial longitudinal movement of the vessel. Thus, vessels incorporating these types of propulsion systems are inherently more maneuverable. However, piloting even these types of vessels in close quarters, especially the larger of these, many be challenging to all but the most experienced helmsmen, especially with presence of unfavorable wind and/or current conditions.

There are various prior art examples aimed at enhancing the slow speed maneuverability of a vessel, however, the most common commercially available involves an internally mounted bow thruster system. The internal bow thruster systems, as based on such prior arts of Aron, Denston, and Kuss, comprise a thrust drive unit mounted within a transverse ducting installed at the bow section of a vessel below the waterline connecting the port and starboard sides of the hull. The drive unit is powered by an electric or a hydraulic motor to drive a single or a multiple propellers coaxially positioned within the tube to induce water flow in the transverse axis of the hull. Such thrust drive unit may also be mounted within a transverse ducting similarly installed at the stern section of a vessel to create the stern thruster system. The bow or stern thrusters normally remain unused, except only while slow speed maneuvering. The bow and stern thruster systems may be operated independently or simultaneously in opposing directions to cause the vessel to rotate about a vertical axis, or simultaneously in the same direction to cause the vessel to laterally traverse.

There are many problems associated with an internally mounted bow or stern thruster system. First, these are costly to install. The installation requires a major below-the-waterline structural modification to the hull of the vessel to incorporate the ducting, which must be performed while the vessel is dry-docked and by a skilled hand. There are various models of such thrust drive units currently available in the after-market. However, the complexity and the cost involved with the installation of such are beyond the means of most pleasure vessel owners, and therefore, the use and the benefits of these devices are generally reserved only for the larger and expensive pleasure yachts or commercial vessels.

Second, the installation of the internal thrust drive unit potentially risks the degradation in the structural integrity in the bow and/or stern sections of the vessel. The weakened structure may develop a failure as a result of navigating through the rough waters or from light bumps or collision with other vessels or the dock structure which otherwise may have been non-detrimental to a hull which had not been so modified.

Third, a structural crack or any failure in the below-the-waterline seal joint, including those seal joints integral to the drive unit mechanism, will results in the water ingestion aboard the vessel. The leakage aboard may take place while the operator is unaware, and if the rate of such leakage is greater than the rate at which the vessel's overboard pump system is able to discharge overboard the vessel may sink.

Fourth, the ducting will incur marine growth and unless costly maintenance is performed regularly, result in reduced performance of the thruster system. With the vessel at dock, the cleaning may be performed only by accessing from a duct opening from either side of the hull. The access to clean the interior of the ducting and the gearbox portion of the drive unit within the ducting is difficult, because the accessibility thereto is inhibited by the propeller(s) and the narrowness of the passageway within the ducting. For similar reasons, the maintenance repair is costly. For maintenance operations requiring the removal of the drive unit from the vessel, either the vessel must first be hauled out of the water and dry-docked, or if the operation must be performed while at dock, special tooling, preparation, and care will be required to properly seal off all of the openings below the waterline prior to detaching the drive unit from the ducting.

Fifth, because holes are created on both sides of the bow due to the ducting, the hydrodynamic effects reacting against the discontinuous surfaces on either side of the hull will generate resistance, and thus reduces the operating efficiency of the vessel.

Finally, yet importantly, the internally mounted system detracts from a valuable and limited usable onboard space within the hull.

Some prior art devices, such as of Wardell and Van Breems address some of the concerns dealing with the internally mounted thruster, especially with one regarding the reduced performance due to the hydro-dynamic resistance, by employing a system of mechanisms for retracting and stowing the thrust drive unit to within the hull cavity while it is being unused. The Van Breems further addresses the maintainability concern by making a detachable thrust drive unit, which may be easily removed from the vessel from the surface of the deck. However, both of these devices still have the disadvantages of costly hull modification and installation, possible reduction in the structural integrity of the hull, and mechanical complexity resulting from the incorporation of the retracting system.

The prior art of Roestenberg is an externally mounted pivotal bow thruster. This device is advantageous over the others in that it may easily be installed from above the waterline and without a major modification made to the hull of the vessel, and thus it is possible for a moderately skilled user to self-install the device using only ordinary tools. The device also has an advantage of incorporating a pivotal retracting mechanism, which stows the drive unit out of the water while the vessel is cruising, and therefore preventing any degraded vessel performance due to the hydrodynamic resistance caused by the drive unit. In addition, the maintenance of the device may be performed easily as the entire drive unit and the pivotal actuator assembly may be detached from the vessel. However, the drawback of the Roestenberg is mechanical complexity and delicate nature of the pivotal retracting mechanism, which may easily incur damage while the vessel is navigating through rough waters.

Similarly, the prior art of Pinsof presents an externally mounted stern thruster adapted for mounting on the transom or on the swim platform attached to the transom in a typical small powered vessel. The installation is performed above the waterline and without a major modification performed to the hull of the vessel, and thus, this enables a moderately skilled user to self-install the device using only ordinary tools. However, the Pinsof's stern thruster has a disadvantage of mechanical complexity associated with the linear or rotary deployment and retracting mechanism employed thereby.

While Wardell, Van Breems, Roestenberg, and Pinsof all cite the advantages of incorporating retractability feature to their thruster systems, it is noted that there are also disadvantages associated with the same. The operator must first deploy the thrust drive unit to the submerged operating position prior to energizing the device. A sustained dry operation of the thruster while the drive unit is out of the water may lead to premature failures of the drive shaft seal(s) or the motor. In addition, the operator must retract the drive unit out of the water prior to commencing high-speed cruise, or the hydrodynamic forces may cause damages to the drive unit and its support structure. It is possible to exclusively interlock the deployment and energization of the drive unit by using position sensors and such, and similarly, to have the retracting operation interlocked with the vessel's instrumentation, so that it automatically retracts when a preprogrammed vessel speed is reached. However, incorporating such safety features will increase complexity and cost and decrease the overall reliability of the thruster system.

BRIEF SUMMARY OF THE INVENTION

This invention addresses the concerns and deficiencies as descried above associated with the prior art and presents an improved bow or stern thruster system. Accordingly, it is an objective of the present invention to provide a simple yet reliable self-contained thrust drive unit which may be easily installed without requiring the vessel to be hauled out of the water.

It is also an objective of the present invention to provide a mounting means for installing the thrust drive unit at the bow of any vessel or on the transom.

It is another objective of the present invention to provide a thrust drive unit which is fixed-mounted in the operating position and non-retractable, so as to free the user from the additional responsibility of having to deploy and retract the unit into and out of the water, thus making it simpler to use.

It is a further objective of the present invention to provide a thrust drive unit with a substantially thin and streamlined lower portion situated below the waterline to minimize hydrodynamic resistance.

It is still another objective of the present invention to provide a thrust drive unit with the motor situated well above the waterline, for better protection from the water.

It is still a further objective of the present invention to provide a thrust drive unit, which may be cleaned easily using only ordinary implements and without special preparations to or partial disassembly nor removal of the drive unit from the hull of the vessel.

It is yet another objective of the present invention to provide a thrust drive unit which is easily detachable from the hull of the vessel for performing any required servicing and subsequently easily reattachable.

It is yet a further objective of the present invention to conserve useable and valuable space in or on the vessel.

These and other objectives are attained by the present invention, which is adapted for attachment on a vessel entirely from the exterior and from above the waterline. The installation is performed using simple tools and with ordinary skills, and in most cases, while the vessel is at dock. The only modifications necessary to the vessel are drilling of small holes above the waterline, and thus there is no concern for water leakage nor weakening of the structural integrity as associated with the installation of most of the prior art examples earlier described.

The thrust drive unit of the present invention is packaged into a self-contained unit with all of the drive components thereof housed within a tough casing and is structurally supported securely onto the vessel by a pair of bracket assemblies. Unlike most prior art examples wherein the propeller(s) is/are coaxially and directly mounted to the output shaft of the motor or of the gearbox, the drive system of the present invention utilizes a flexible drive belt, which mechanically couples the motor situated at the upper end of the casing to the peripherally-driven propeller situated at the opposite lower end. Such remote coupling arrangement has an advantage of having the motor positioned out of the water to better protect it from the harmful effects thereof and thus improving longevity. Another advantage is that it is possible to configure the lower submerged portion of the thruster that has a thin cross section along the horizontal plane with a thickness across the lateral width, of substantially 1.5 inches or less, and is longitudinally streamlined to enable it to efficiently traverse through the water with a minimum resistance. Such hydrodynamically efficient design enables the thrust drive unit of the present invention suitable for being fixedly mounted in the operating position with respect to a vessel. Compared with all of the prior art examples cited, the non-retractable, fixedly mounted embodiment, in combination with the external, above-the-waterline installation, renders the present invention much less complicated, easy to install, and more conserving of the space in or on the vessel.

For bow mounting, a pair of universally adjustable bow mounting bracket assembly of the present invention allows for installation of the thrust drive unit on the stern of any vessel. The seat portions of these bracket assemblies which attach to each side of the stern are adjustable for varying of inclusive angles therebetween independently about two axes, thus enabling the bracket assembly to adapt to any bow form of any vessel. Also, the opposite end portions of the bracket assemblies which attach to the thrust drive unit for support thereof are pivotally adjustable about a lateral axis with respect to the thrust drive unit, thus providing the bracket assemblies yet another axis of adjustment to enable adapting to various bow silhouette of substantially curved or straight shape. The bracket assembly may also be adjusted as required for mounting the thrust drive unit at any vertical position with respect to the stern of a vessel.

The present invention may also be installed on the transom of any vessel having one, by employing a set of brackets adapted to fit the contour of the transom of any individual vessel. The transoms in most vessels are substantially flat, and thus adapting a bracket to fit thereto is relatively easy.

Where each of the bracket assemblies is attached to the thrust drive unit is a single pair of bolt and a nut, which enables the pivoting adjustability as described above. This also enables a quick and easy removal of the thrust drive unit from the vessel for servicing and for a vessel-to-vessel transfer. The bracket assemblies remain attached to the vessel with the adjustments intact, such that it allows quick and easy subsequent reinstallation of the thrust drive unit.

The following illustrative drawings and detailed description make the foregoing and other objects, features, and advantages of the invention more apparent.

DETAILED DESCRIPTION OF THE INVENTION

Figure 1:
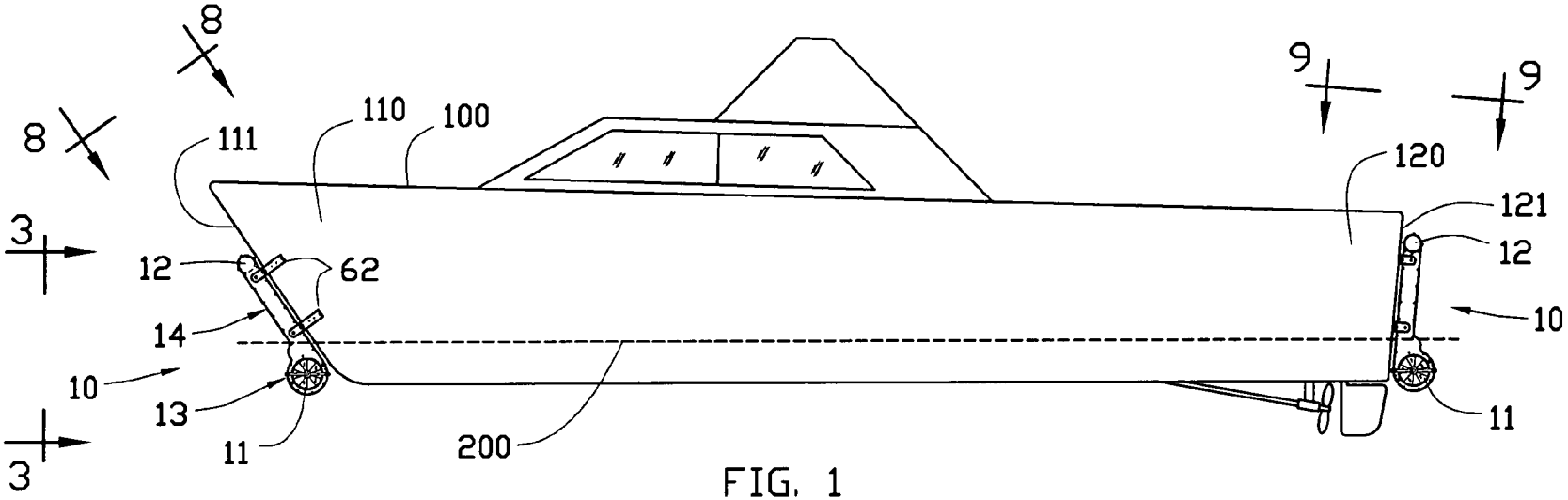
FIG. 1 of the drawings is an elevation view of a modern powered vessel with the thrust drive unit of the present invention installed on the stern and on the transom.
Figure 2:
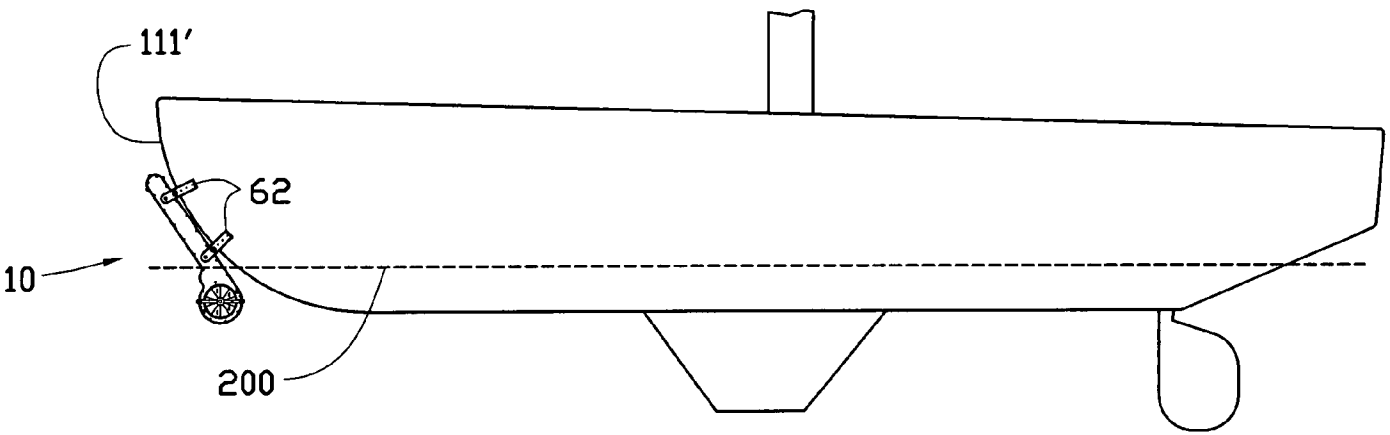
FIG. 2 is an elevation view of another modern vessel with a stern of a substantially curved silhouette and the thrust drive unit of the present invention installed thereon.
Figure 3:
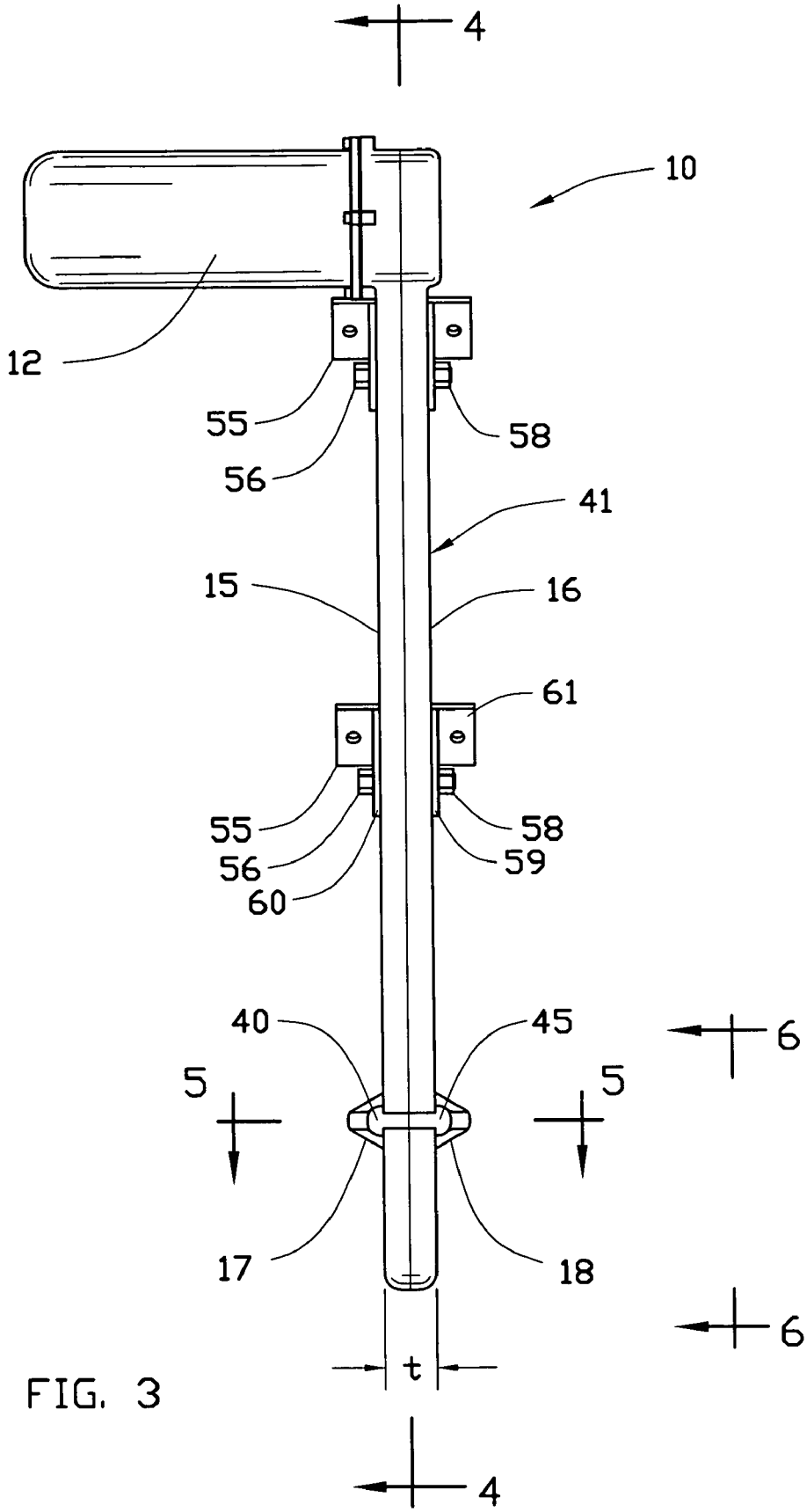
FIG. 3 shows the thrust drive unit of the present invention as viewed in the direction 3—3 established in FIG. 1.

FIGS. 1–11 of the drawing illustrate various aspects of a lateral thrust drive unit 10 constructed according to the present invention. Referring to FIG. 1, a vessel 100 is illustrated with the present invention 10 mounted on the stern 111 at the bow 110 and on the transom 121 at the stern 120 thereof. The illustrated vessel in FIG. 1 is a typical modern powered watercraft in the 25–30 feet range with an inboard-engine-driven single screw propulsion system with an ordinary rudder for steering. However, as already mentioned, the thrust drive unit 10 of the present invention may be conveniently installed about the stern and/or on the transom of any kind and size of vessel. The present invention is equally adaptable for mounting onto a vessel with a stern of a substantially straight silhouette, as shown in FIG. 1, or that of a substantially curved, as shown in FIG. 2.

The thrust drive unit 10 is fixedly mounted and vertically adjusted to a normal, installed position with respect to the vessel that the lower portion 13 of the thrust drive unit is situated below the waterline 200 to ensure the propeller 11 is fully submerged under water. At the opposing extremity on the upper portion 14 of the thrust drive unit is a reversible electric or hydraulic motor 12, which is maintained above the waterline. Compared with most of the prior art examples listed in the References Cited, of Aron, Denston, Kuss, Medynski, Pinsof, Roestenberg, and Van Breems, wherein the propeller(s) is/are coaxially and directly mounted to the output shaft of the motor or the gearbox, the unique architecture of the present invention, wherein the submerged propeller 11 is peripherally driven by the power source 12 which is situated away from and above the waterline 200, makes it possible for the submerged lower portion 13 to have a substantially thin cross section with a narrow thickness along the transverse axis of the vessel. This renders the thrust drive unit of the present invention hydro-dynamically efficient and low resistance generating. In the preferred embodiment, the transverse thickness, t, shown in FIG. 3 across the narrow section of the submerged portion is approximately 1.5 inches.

Figure 4:
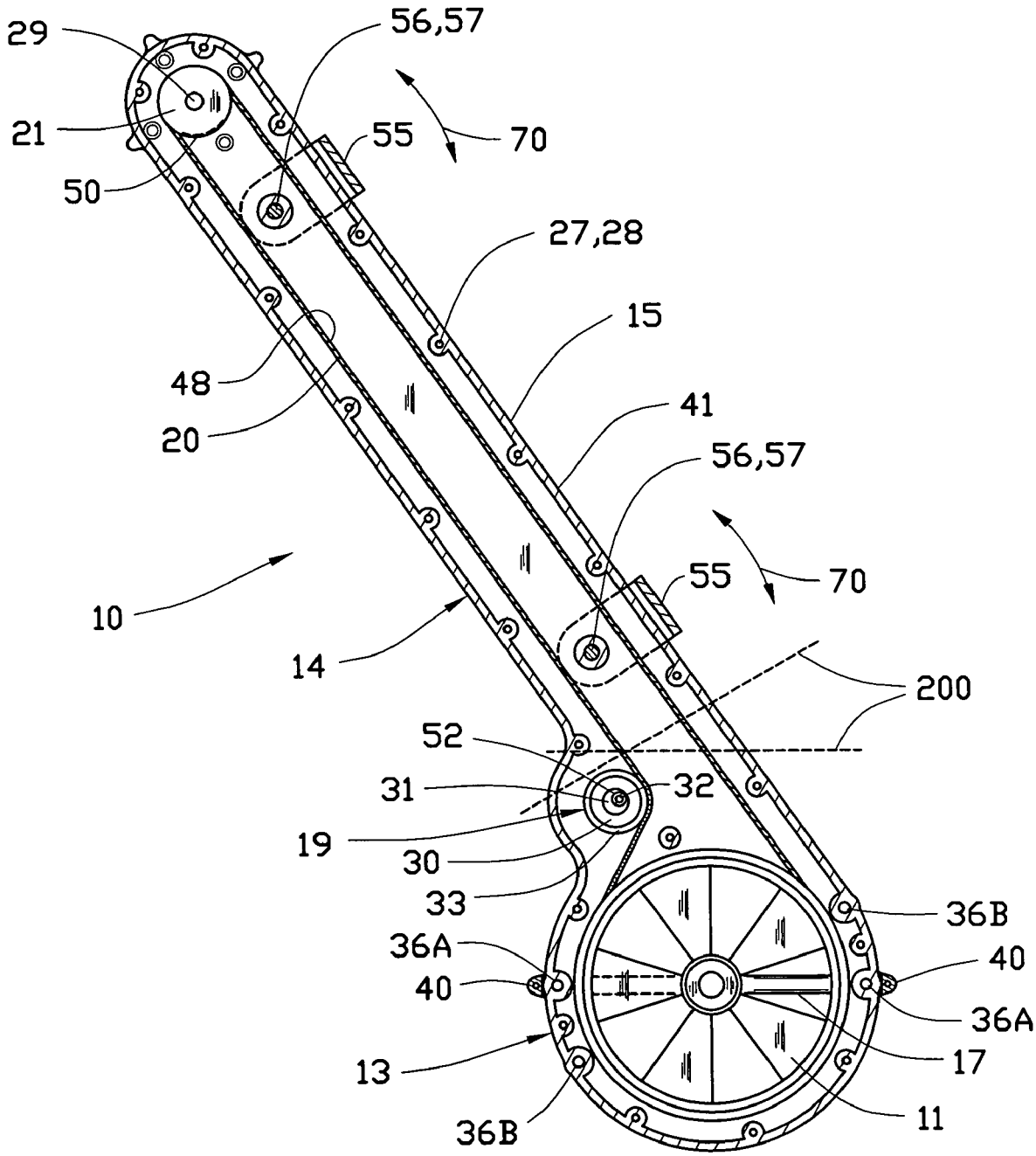
FIG. 4 is a partial cross section of the thrust drive unit of the present invention as viewed along the section plane 4—4 and in the direction established in FIG. 3.

Now, referring to FIG. 4 of the drawing, the thrust drive unit 10 comprises a first casing half 15 (shown), a second casing half 16 (opposite side), a motor 12, a first propeller support 17 (shown), and a second propeller support 18 (opposite side), wherein the first and second casing halves are secured to each other using a plurality of screws 27 and nuts 28 to create a rigid casing 41 to provide as support foundation for the motor and the two propeller supports. Within the interior of the casing 41 are a drive pulley 21, a drive belt 20, and a propeller 11, wherein the drive pulley is affixed to the shaft 29 of the motor 12 to impart the torque generated by the motor to the drive belt to further transmit the power to the propeller. Also housed within the casing is a drive belt tension idler 19, which is adjusted to create and maintain a proper tension in the drive belt as necessary to prevent slippage thereof.

Figure 7:
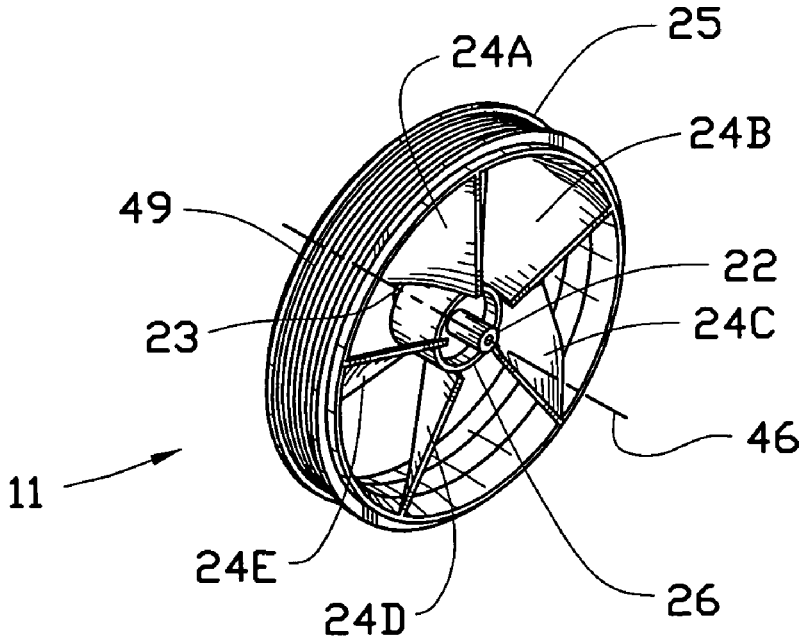
FIG. 7 is an isometric illustration of the propeller of the present invention.

The propeller 11 as best shown in FIG. 7 is of a one piece construction comprising an annular shroud 25, which is specifically formed and devised on its periphery to make the propeller to function as a belt driven pulley, a hub portion 26, which is coaxially disposed about the center axis 46 of the annular shroud 25, and a pair of opposing shaft ends 22 and 23, each coaxially aligned with the same center axis. Within the annular space between the annular shroud 25 and the hub portion 26 are a set of propeller blades 24 (A–E) radially disposed about the center axis 46. The propeller blades 24 (A–E) are attached at the outer ends to the inner wall of the annular shroud 25 and at the inner ends to the hub portion 26 to structurally support to create a singular propeller 11 with necessary strength and rigidity.

In the preferred embodiment, the drive belt 20 which transmits the torque generated by the motor 12 to the propeller 11 is a flexible belt of a kind typically used in modern automotive or marine engine accessory drive systems. The side of the belt designed to engage with the pulleys incorporates a plurality of mini vee-bands 48 each disposed continuously along the entire length of the belt. These bands cooperate with the mating vee-grooves 49 on the periphery of the annular shroud 25 of the propeller 11 and the grooves 50 on that of the drive pulley 21. A drive belt of this kind is commonly referred to in the automotive and marine industries as the "serpentine belt". It is obvious that any of the other kinds of flexible drive belts, such as a vee-belt, a cog-belt, or a timing-belt in combination with corresponding mating means will serve just as well as the serpentine drive belt for the purpose of the invention. In addition, a chain, similar to those used in a bicycle power transmission system in combination with mating sprockets would work just as well.

The drive belt tension idler assembly 19 is supported by and secured to the casing half 15 by a screw 32 and positioned adjacent to the mid span of the drive belt 20. The assembly comprises an idler pulley 33 press-fitted over the outer race of a ball bearing 30 which in turn is press-fitted by its inner race over the outside diameter of an eccentric bushing 31. With the drive pulley, the drive belt, and the propeller situated in their respective positions, the tension adjustment may be accomplished by rotating the tension idler assembly 19, more specifically the eccentric bushing 31 about its center bore 52 in either direction as required to obtain a desired level of tension. The tension adjustment may be locked by securing the final position of the eccentric bushing to the housing half 15 by tightening the screw 32. The ball bearing 30 is a corrosion resistant, grease-packed, and sealed type to enable reliable and uninhibited operation of the idler pulley while submerged under water.

Figure 5:
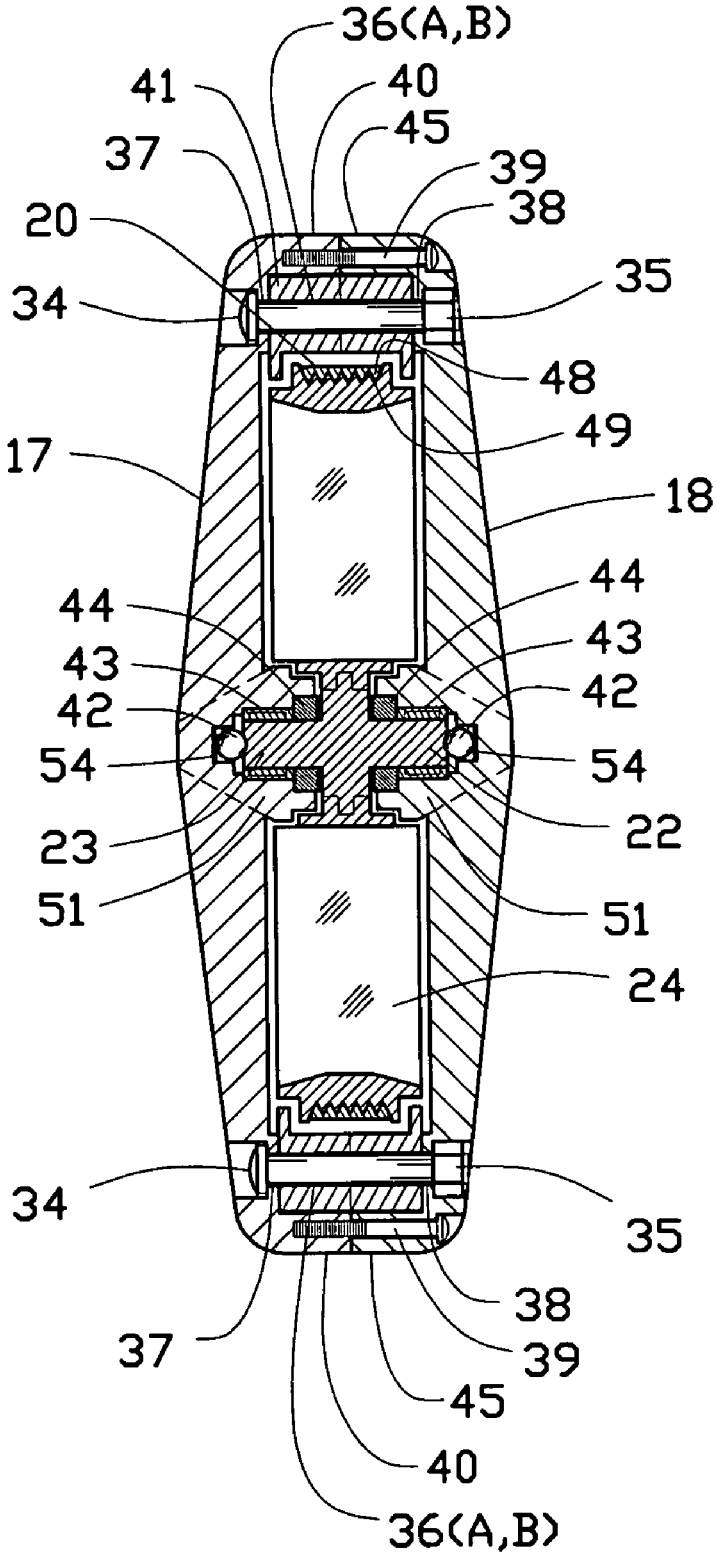
FIG. 5 is an enlarged partial cross section of the thrust drive unit as viewed along the section plane 5—5 and in the direction established in FIG. 3.
Figure 6:
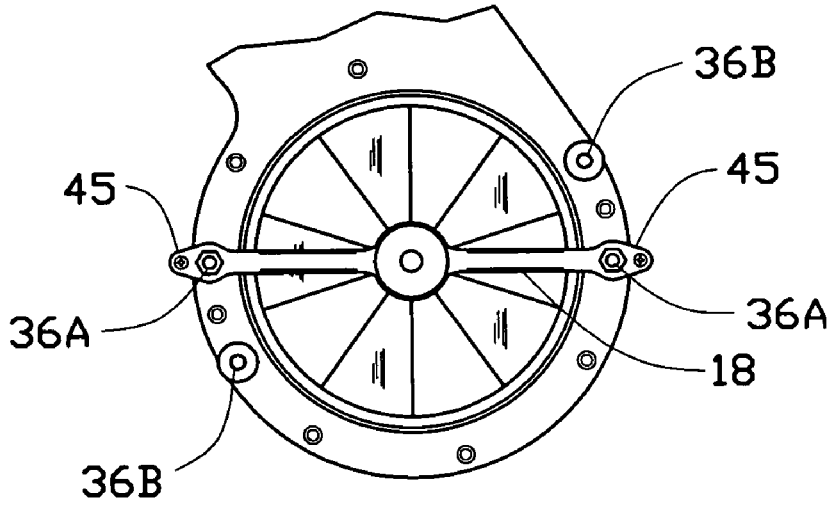
FIG. 6 is an outside view of the lower portion of the thrust drive unit as viewed in the direction 6—6 established in FIG. 3.

Now referring to FIG. 5 of the drawing, the first propeller support 17 and the second propeller support 18 are placed externally over, one on each side of, the casing 41. Each of the pair of holes 37 in the first hub support 17 and each of those holes 38 in the second hub support 18 are coaxially aligned with each of the either of the pair 36A or 36B (best shown in FIG. 4 and FIG. 6) within the casing 41. For a bow stern installation as illustrated in FIG. 1 and FIG. 2, the propeller supports 17 and 18 are installed using the pair 36A in the casing. A pair of screws 34 is inserted into the holes 37 and is extended through the holes 36A, then further through the holes 38, and are secured using a pair of nuts 35. This method of fastening allows for both secure mounting and precise positioning of the propeller supports 17 and 18 on and with respect to the casing 41. For a transom installation as illustrated in FIG. 1, the pair of holes 36B in the casing 41 are used instead. The objective is to select either the set of holes 36A or 36B which would allow for the most substantially horizontal installation of the propeller supports, which in turn will result in creating the least amount of hydro-dynamic resistance while the thrust drive unit traverses through the water.

The lengths of the strut portions of the propeller supports are elongated beyond the support edges in the casing 41 and are terminated with the tips 40 in the first propeller support 17 and the tips 45 in the second propeller support 18. Each of these extended tips are configured to snuggly fit around the external contour of the support edges in the casing and are further disposed such that each of the tips 40 mates with that 45 to form an abutment joint which is secured using a screw 39. Secured together, the tips 40 and 45 form bulbous leading and trailing edges to further improve the hydrodynamic performance characteristics of the lower portion 13.

Each of the propeller supports 17 and 18 include a series of bores coaxially disposed within the center hub portion 51. Within each of the first of these bores is press fitted a shaft seal 44 designed to keep the water out and to retain the grease within the bores. Within each of the second of these bores is housed a grease-packed roller bearing 43 press fitted therein to provide as a rotating support for each of the shaft ends 22 and 23 of the propeller. In each of the third of these bores is a bearing ball 42 and shims 54 disposed therein to absorb the axial thrust force generated by the propeller while in operation. The thickness of the shims 54 may be adjusted from each side of the propeller to take up any unnecessary play and to properly position the propeller centered along the axial direction.

Now referring back to FIG. 3, the thrust drive unit 10 incorporates two mounting flanges 55 each comprising a pair of arm portions 59 and 60 and a flange portion 61, wherein the pair of arm portions are so configured and disposed that they cradle the casing 41 snuggly by the sides within the space therebetween. The mounting flanges 55 are each secured to the thrust drive unit 10 using a bolt 56, which is inserted into the hole in the first arm portion 60, then extended through the hole 57 across the width of the casing 41, and further through the hole in the second arm portion 59 and secured thereon using a nut 58. The mounting flanges are positioned substantially spaced from one another to provide a sufficient distribution of the structural loads.

Figure 8:
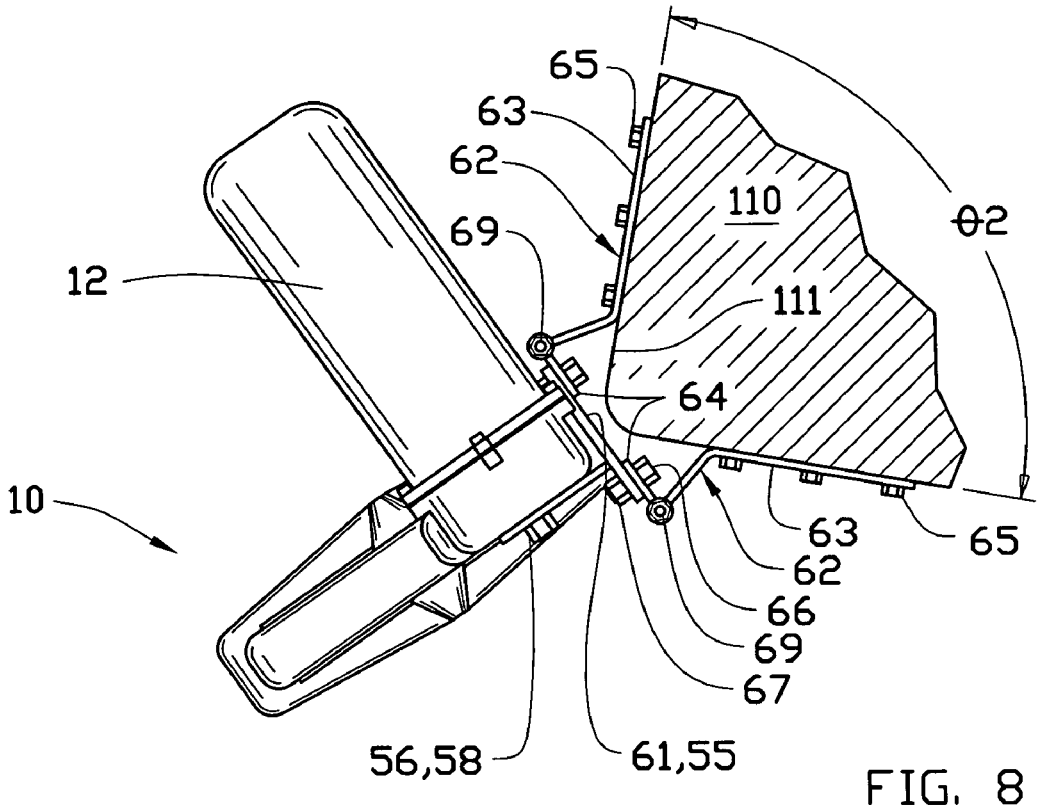
FIG. 8 shows the thrust drive unit in combination with a universal bow mounting bracket assembly according to the invention installed on the stern at the bow of a modern vessel as viewed in the direction 8—8 established in FIG. 1.
Figure 10:
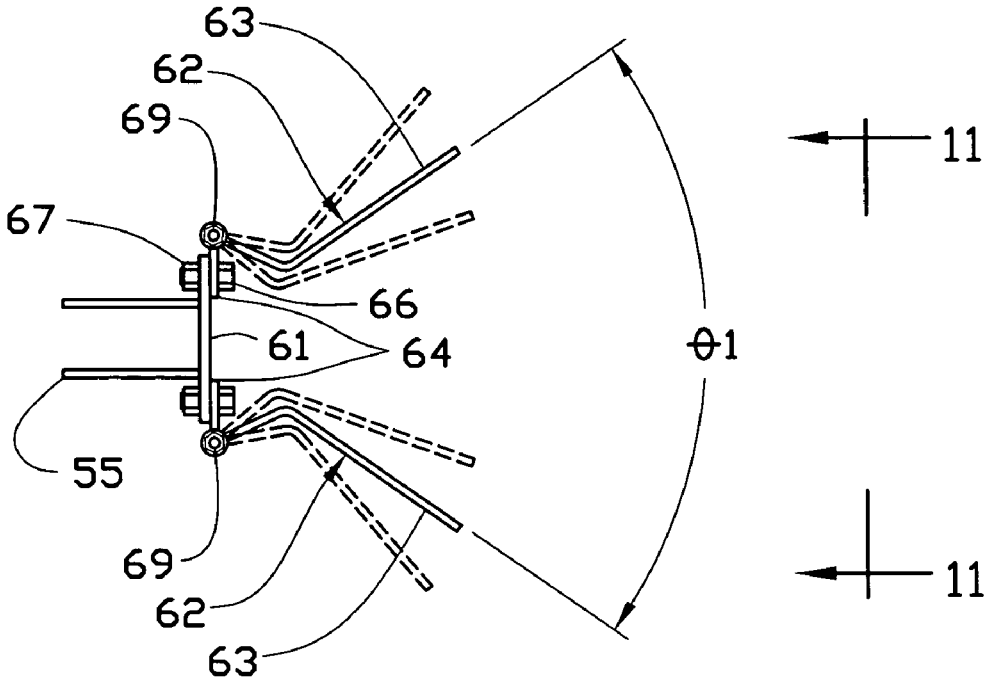
FIG. 10 shows the universal bow mounting bracket assembly of the present invention. For simplicity and clarity, the thrust drive unit is not shown.

Installation of the thrust drive unit 10 on the bow of a vessel as shown in FIG. 1 and FIG. 2 requires two pairs of identical bow mounting brackets 62, wherein each pair is adjustably situated about the stern 111 as shown in FIG. 8 and provides as a structural means for support of the two mounting flanges 55. As shown in FIG. 8 and FIG. 10, each bow mounting bracket 62 comprises a stern seat 63 adapted for attachment on the stern using a plurality of self tapping screws 65, a support plate 64 hingedly attached thereto, and a hinged joint 69. The flange portion 61 of the upper of the two mounting flanges 55 is attached to the support plates 64 of the upper pair of the bow mounting brackets 62 and secured thereto using a pair of bolts 66 and nuts 67, and the lower of the two mounting flanges is supported and secured in the same manner to the lower pair of the bow mounting brackets.

Figure 11:
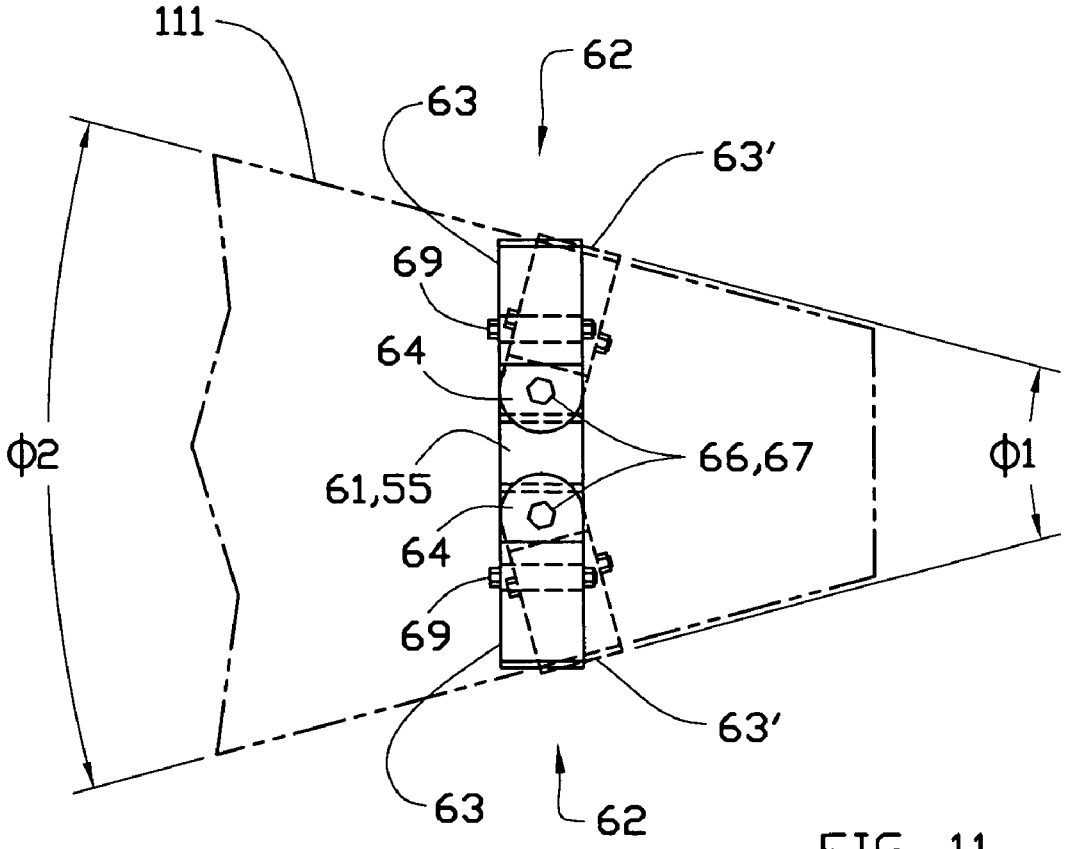
FIG. 11 shows the universal bow mounting bracket assembly as viewed in the direction 11—11 established in FIG. 10.

Disposed and arranged so as above described, the combination of the pair of bow mounting brackets 62 and the mounting flange 55 establish a universally adjustable means which is adjustable in three mutually independent axes to enable adapting to any bow form. As shown in FIG. 10, the hinged joints 69 allow for an adjustable angle θ1 between the stern seats 63 for adapting to the horizontal component angle θ2 of a bow. Concurrently, as shown in FIG. 11, each of the fastened joints between the flange portion 61 and the support plate 64 is pivotally adjustable about the center axis of the bolt 66 perpendicular to the axis of the hinged joints 69 to create an adjustable angle $\phi 1$ between the seat portions 63' for adapting to the vertical component angle $\phi 2$ of a bow. The vertical cross section of the bow is represented by phantom lines in FIG. 11. Further, as shown in FIG. 4, each of the mounting flanges 55 may also be articulated about the center axis of the bolt 56 through an arc 70 with respect to the body of the thrust drive unit to facilitate adapting to various silhouette of the stern of any vessel. FIG. 2 illustrates the thrust drive unit adapted to fit a stern 111' of a substantially curved silhouette as found in some sailing vessels.

Figure 9:
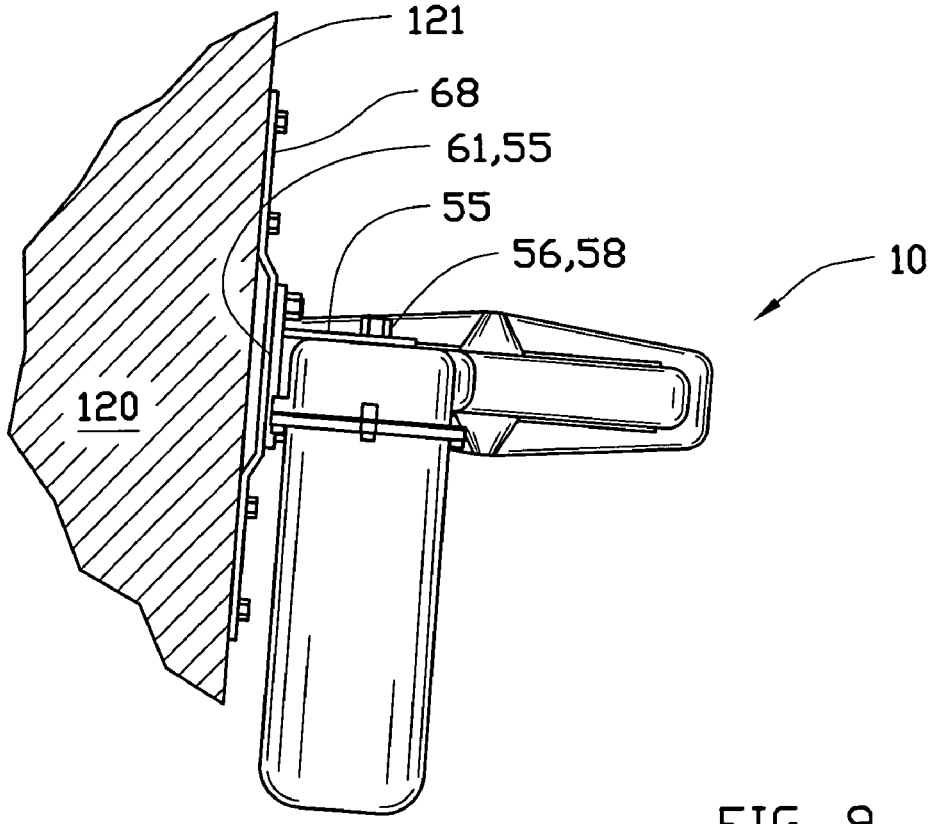
FIG. 9 shows the thrust drive unit in combination with a transom-mounting bracket according to the invention installed on the transom of a vessel as viewed in the direction 9—9 established in FIG. 1.

Installation of the thrust drive unit on the transom of a vessel as shown in FIG. 1 and FIG. 9 is relatively simple, requiring only a pair of support brackets 68 configured to fit the substantially flat contour of the transom 121 for providing a support foundation for the mounting flanges 55 of the thrust drive unit.

The thrust drive unit of the present invention is operated using a conventional power source, such as electric power, in case of an electric motor, or a hydraulic pressure, in case of a hydraulic motor. The thrust drive unit may be installed and operated at either the bow of the vessel to generate a lateral movement of the bow, which results in a similar but opposite lateral movement of the stern, or at the stern, to generate a lateral movement of the stern which results in a similar but opposite lateral movement of the bow. This enables the vessel to steer effectively at slow speeds or while moving in reverse by use of the lateral thruster and without the use of the rudder. In addition, two thrust drive units may be installed one at the bow and another at the stern and together operated in the same direction to propel the vessel sideways. Such lateral maneuvering is extremely helpful while docking into a tight space between two already docked vessels at a long dock, which is analogous to a situation involving parallel parking of automobiles. The electric voltage or the hydraulic fluid flow rate may be modulated to adjust the magnitude of thrust produced by the thrust drive unit and the polarity of the electric voltage or the direction of the hydraulic flow may be reversed to cause the reversal of the thrust direction.

The preferred means for generating the user input necessary to operate the thrust drive unit is a three-position, on-off-on, toggle switch of a type common in the art, which is spring-loaded returned to the middle, neutral position, when released. One such switch is used with each thrust drive unit and wired and positioned at the helm station to allow intuitive operation by the helmsman, such that right toggle movement results in the thrust generation toward the starboard side and the left toggle movement results in the thrust generation toward the port side. Use of a toggle switch will suffice where a single speed control of a fixed thrust magnitude is satisfactory, as such is the case for most small vessel applications. However, for larger vessels, or where variable magnitude thrust control is desirable, use of a joystick type input device in combination with a variable speed controller would be preferred. Such combination used in a variable speed control application is well known in the art.

Ease of servicing is an added benefit of the preferred embodiment. The thrust drive unit of the present invention may be safely removed from the vessel simply by removing the nuts 58 and bolts 56 from the mounting flanges 55. The entire thrust drive unit 10 may then be lifted out from the cradle of the mounting flanges 55 while the vessel is at dock. Maintenance cleaning is also easy as the propeller 11 is readily accessible for cleaning from both starboard and port sides. The cleaning of the thrust drive unit of the invention may thus be performed using ordinary brushes and rags and as part of the vessel's scheduled periodic underwater hull cleaning process.

The present invention thus provides a thrust drive unit, which provides the user with a simple and inexpensive, yet reliable means for outfitting a vessel for superior maneuverability. The present invention may be installed on the hull of the vessel by a moderately skilled user using simple tools and the required operation performed above the waterline allowing the vessel to remain at dock while the installation is taking place. A unique design of the present invention allows for only the thin and blade-like portion of the thrust drive unit to be fixedly remain below the waterline and therefore allowing for a hydro-dynamically efficient operation, simpler mechanisms, higher mechanical reliability, and ease of operation.

Based upon the foregoing, one of ordinary skill in the art can readily practice the invention. Although an exemplary embodiment have been shown and described, it is believed that one of ordinary skill in the art may make change, modifications, and substitutions without necessarily departing from the spirit and scope of the invention.

I claim:

1. A lateral thrust drive unit adapted to be mounted on a stem or at a transom of a vessel having a bow, a stern, and a waterline, for generating thrust along the transverse axis of said vessel, said thrust drive unit comprising:

a substantially hollow casing having an upper portion and a lower portion, wherein said upper portion is adapted for being situated above said waterline of said vessel and said lower portion is adapted for being situated below the same and said lower portion having a substantially thin cross section with a narrow thickness along the thrust axis of the thrust drive unit parallel to said transverse axis of the vessel;

a propeller disposed substantially within said lower portion and so adapted for rotation about and for creating thrust along said thrust axis having (i) a shaft with two opposing ends, (ii) an annular shroud concentrically disposed about said shaft, (iii) a plurality of propeller blades radially disposed about said shaft, wherein one end of each of the blades is attached to said shaft and the opposite end of the same to the inner wall of said annular shroud, and (iv) said annular shroud having on its periphery a means for engaging with a power transmitting means;

a pair of propeller supports each having a hub and a plurality of struts radially disposed thereabout transverse to the center axis of the hub, wherein each of the propeller supports are so adapted and mounted on each of the opposing sides across said narrow thickness of said lower portion that each of said center axis of the hub is coaxially aligned with said thrust axis and each of the propeller supports further having a cylindrical recess coaxially within said hub and a bearing means received therewithin for rotatably and axially supporting said propeller by each of said opposing ends of the shaft;

a power generating means comprising (i) a reversible motor mounted to said upper portion of said casing and having an output shaft which is accommodated within said casing and (ii) a drive pulley disposed within said casing and attached to said output shaft and having on its periphery a means for engaging with a power transmitting means;

a power transmitting means comprising a flexible drive member disposed within said casing and engagingly wrapped partially around the peripheries of said drive pulley and said propeller for transmitting the mechanical power from said power generating means to said propeller; and a plurality of mounting flanges for supporting said casing, wherein the mounting flanges are so adapted that they are each pivotally movable with respect to the casing about a first pivot axis parallel to said thrust axis.

2. A lateral thrust drive unit as recited in claim 1 further comprising a plurality of a universally adjustable pair of bow mounting brackets for mounting the lateral thrust drive unit on the stern of any vessel, wherein:

each bow mounting bracket comprising a stern seat and a support plate hingedly attached thereto, wherein the support plate is secured to said pivotally movable mounting flange and pivotally adjustable with respect thereto about a second pivot axis perpendicular to said first pivot axis; and each of the stern seats hingedly movable with respect to said support plate about a third pivot axis perpendicular to said second pivot axis.

3. A lateral thrust drive unit as recited in claim 1, wherein said pair of propeller supports and said casing are so adapted to allow for adjustably mounting the propeller supports on the casing at one of several angular orientations with respect to the casing about said thrust axis.

4. A lateral thrust drive unit as recited in claim 1, wherein said plurality of struts is two struts disposed about said hub in substantially opposing directions transverse to said center axis of the hub.

5. A lateral thrust drive unit as recited in claim 1 further including a tension adjusting means for adjusting and maintaining the tension in said flexible drive member.

6. A lateral thrust drive unit as recited in claim 1, wherein said flexible drive member is a drive belt.

7. A lateral thrust drive unit as recited in claim 1, wherein said flexible drive member is a drive chain.

8. A lateral thrust drive unit as recited in claim 1, wherein said plurality of mounting flanges is two.

9. A lateral thrust drive unit as recited in claim 2, wherein said plurality of a pair of bow mounting brackets is two pairs.

10. A lateral thrust drive unit as recited in claim 1, wherein said annular shroud and propeller blades of said propeller are so proportioned that they fit within said narrow thickness of said lower portion of said casing.

11. A lateral thrust drive unit as recited in claim 1, wherein said narrow thickness of said lower portion of said casing is 2 inches or less.

12. A lateral thrust drive unit as recited in claim 5, wherein said tension adjusting means comprising an idler pulley and an eccentric bushing which further comprises a bore and an outside diameter eccentrically disposed thereabout, wherein said idler pulley is rotatably mounted on said outside diameter of said bushing and so disposed to maintain contact with said flexible drive member and said eccentric bushing rotatably adjustable about and secured to the casing by the bore to adjust the lateral position of the idler pulley with respect to said flexible drive member.

13. A lateral thrust drive unit adapted to be mounted on a stern or at a transom of a vessel having a bow, a stern, and a waterline, for generating thrust along the transverse axis of said vessel, said thrust drive unit comprising:

a substantially hollow casing having a lower portion adapted for operating below said waterline and having a substantially thin cross section with a narrow thickness along the thrust axis of the thrust drive unit parallel to said transverse axis of the vessel;

a propeller disposed substantially within said lower portion and so adapted for rotation about said thrust axis having (i) a shaft with two opposing ends, (ii) an annular shroud concentrically disposed about said shaft, (iii) a plurality of propeller blades radially disposed about said shaft, wherein one end of each of the blades is attached to said shaft and the opposite end of the same to the inner wall of said annular shroud, and (iv) said annular shroud having on its periphery a means for engaging with a power transmitting means;

a pair of propeller supports each having a hub and two struts radially disposed thereabout in substantially opposing directions transverse to the center axis of the hub, wherein each of the propeller supports are so adapted and mounted on each of the opposing sides across said narrow thickness of said lower portion that each of said center axis of the hub is coaxially aligned with said thrust axis and each of the propeller supports further having a cylindrical recess coaxially within said hub and a bearing means received therewithin for rotatably and axially supporting said propeller by each of said opposing ends of the shaft;

a power generating means comprising (i) a reversible motor mounted to said casing and having an output shaft which is accommodated within said casing and (ii) a drive pulley disposed within said casing and attached to said output shaft and having on its periphery a means for engaging with a power transmitting means;

a power transmitting means comprising a drive belt disposed within said casing and engagingly wrapped partially around the peripheries of said drive pulley and said propeller for transmitting the mechanical power from said power generating means to said propeller; and a drive belt tensioning means.

14. A lateral thrust drive unit as recited in claim 13, wherein said annular shroud and propeller blades of said propeller are so proportioned that they fit within said narrow thickness of said lower portion of said casing and said narrow thickness is 2 inches or less.

15. A lateral thrust drive unit as recited in claim 13, wherein said pair of propeller supports and said casing are so adapted to allow for adjustably mounting the propeller supports on the casing at one of several angular orientations with respect to the casing about said thrust axis.

16. A lateral thrust drive unit as recited in claim 13, wherein said drive belt tensioning means comprising an idler pulley and an eccentric bushing which further comprising a bore and an outside diameter eccentrically disposed thereabout, wherein said idler pulley is rotatably mounted on said outside diameter of said bushing and so disposed to maintain contact with said drive belt and said eccentric bushing rotatably adjustable about and secured to the casing by said bore to adjust the lateral position of the idler pulley with respect to said drive belt.

17. A lateral thrust drive unit adapted to be mounted on a stern or at a transom of a vessel having a bow, a stern, and a waterline, for generating thrust along the transverse axis of said vessel, said thrust drive unit comprising:

a substantially hollow casing having a lower portion adapted for operating below said waterline and having a substantially thin cross section with a narrow thickness along the thrust axis of the thrust drive unit parallel to said transverse axis of the vessel;

a propeller disposed substantially within said lower portion and so adapted for rotation about said thrust axis having (i) a hub with a center bore, (ii) an annular shroud concentrically disposed about said center bore of said hub, (iii) a plurality of propeller blades radially disposed about said hub, wherein one end of each of the blades is attached to said shaft and the opposite end of the same to the inner wall of said annular shroud, and (iv) said annular shroud having on its periphery a means for engaging with a power transmitting means;

a propeller support means including a shaft adapted to be received within said center bore of said hub for rotatably supporting said propeller;

a power generating means comprising (i) a reversible motor mounted to said casing and having an output shaft which is accommodated within said casing and (ii) a drive pulley disposed within said casing and attached to said output shaft and having on its periphery a means for engaging with a power transmitting means;

a power transmitting means comprising a drive belt disposed within said casing and engagingly wrapped partially around the peripheries of said drive pulley and said propeller for transmitting the mechanical power from said power generating means to said propeller; and a drive belt tensioning means.

18. A lateral thrust drive unit as recited in claim 17, wherein said annular shroud and propeller blades of said propeller are so proportioned that they fit within said narrow thickness of said lower portion of said casing and said narrow thickness is 2 inches or less.

19. A lateral thrust drive unit as recited in claim 17, wherein said propeller support means and said casing are so adapted to allow for adjustably mounting the propeller support means on the casing at one of several angular orientations with respect to the casing about said thrust axis.

20. A lateral thrust drive unit as recited in claim 17, wherein said propeller support means comprising:

a pair of propeller supports each having a hub and two struts radially disposed thereabout in substantially opposing directions transverse to the center axis of the hub, wherein each of the propeller supports are so adapted and mounted on each of the opposing sides across said narrow thickness of said lower portion that each of said center axis of the hub is coaxially aligned with said thrust axis; and said shaft for rotatably supporting said propeller having two opposing ends, wherein each of the ends is supported by each of said propeller supports and is coaxially aligned with said center axis of the hub.

* * * * *

UNITED STATES PATENT AND TRADEMARK OFFICE

CERTIFICATE OF CORRECTION

PATENT NO. : 6,964,590 B1
DATED : November 15, 2005
INVENTOR(S) : Don Dongcho Ha It is certified that error appears in the above-identified patent and that said Letters Patent is hereby corrected as shown below:

Column 5,
Lines 9, 11, 22, 45, 47 and 64, “stern” should read -- stem --.

Column 6,
Lines 18, 24 and 26, “stern” should read -- stem --.

Column 7,
Line 58, “stern” should read -- stem --.

Column 8,
Lines 47, 50, 51 and 66, “stern” should read -- stem --.

Column 9,
Lines 11 and 12, “stern” should read -- stem --.

Column 11,
Lines 18, 19 and 25, “stern” should read -- stem --.

Column 12,
Line 2, “stern” should read -- stem -- (both occurrences).

Column 13,
Line 2, “stern” should read -- stem --.

Signed and Sealed this

Twenty-eighth Day of February, 2006

JON W. DUDAS
*Director of the United States Patent and Trademark Office*